US005609748A

United States Patent [19]

Kotowski et al.

[11] Patent Number: 5,609,748

[45] Date of Patent: Mar. 11, 1997

[54] ANODE FOR CATHODIC PROTECTION AGAINST CORROSION

[75] Inventors: Stephan Kotowski, Seligenstadt; Reinhard Bedel, Muehlheim-Laemmerspiel; Bernd Busse, Darmstadt, all of Germany

[73] Assignee: Heraeus Elektroden GmbH, Hanau, Germany

[21] Appl. No.: 454,622

[22] Filed: May 31, 1995

Related U.S. Application Data

[63] Continuation of Ser. No. 794,322, Nov. 12, 1991, abandoned, which is a continuation of Ser. No. 458,727, filed as PCT/EP89/00599, May 30, 1989, published as WO90/01570, Feb. 22, 1990, abandoned.

[30] Foreign Application Priority Data

Aug. 9, 1988 [DE] Germany ..... 38 26 926.0

[51] Int. Cl.[6] ..... C23F 13/00

[52] U.S. Cl. ..... 205/734; 204/196; 204/290 F

[58] Field of Search ..... 204/196; 205/734

[56] References Cited

U.S. PATENT DOCUMENTS

| | | | |
|---|---|---|---|
| 3,133,872 | 5/1964 | Miller et al. | 204/196 |
| 3,192,144 | 6/1965 | Heuze | 204/196 |
| 4,255,241 | 3/1981 | Kroon et al. | 204/196 |
| 4,692,066 | 9/1987 | Clear | 204/147 |
| 4,855,024 | 9/1989 | Drachnik et al. | 204/196 |
| 4,900,410 | 2/1990 | Bennett et al. | 204/147 |

FOREIGN PATENT DOCUMENTS

| | | |
|---|---|---|
| 0147977 | 7/1985 | European Pat. Off. . |
| 0407348 | 1/1991 | European Pat. Off. . |
| WO86/06759 | 11/1986 | WIPO . |
| WO86/06758 | 11/1986 | WIPO . |

OTHER PUBLICATIONS

Kotowski, Busse & Bedel, "Titananoden für den Kathodischen Korrosion Schutz von Stahl in Beton" [Titanium Anodes for Cathodic Corrosion Protection of Steel in Concrete], Feb. 1988, in *Metall*, 42nd Year, No. 2; pp. 133–140.

*Primary Examiner*—T. Tung

*Attorney, Agent, or Firm*—Frishauf, Holtz, Goodman, Langer & Chick, P.C.

[57] ABSTRACT

For cathodic protection against corrosion of steel reinforcements in reinforced steel constructions, a prefabricated anode is provided which has a core of titanium expanded metal provided with an activation layer and with a cement-containing ion-conductive jacket; the prefabricated anode is immovably secured to the reinforced concrete construction in an ion-conductive bond; after that, the reinforcement of the concrete construction and the core of the anode are connected to the poles of a direct voltage source.

6 Claims, 2 Drawing Sheets

ANODE FOR CATHODIC PROTECTION AGAINST CORROSION

This application is a continuation of application Ser. No. 07/794,322 filed Nov. 12, 1991, now abandoned, which is a continuation of application Ser. No. 07/458,727 filed Feb. 2, 1990, now abandoned, which is the United States national phase application of International Application No. PCT/EP89/00599 filed May 30, 1989 published as WO90/01570, on Feb. 22, 1990.

The invention relates to an anode having a core of valve metal with an activation layer covering it, for cathodic corrosion protection for a steel reinforcement in concrete, to its use, and to a method for cathodic protection against corrosion.

As a rule, in cathodic protection against corrosion of steel and concrete, a meshlike electrode is applied in planar fashion on an existing component that is to be rehabilitated. A description of this is found for instance in the journal "Metall" [Metal] No. 2, February 1988, Metall-Verlag GmbH Berlin/Heidelberg, Year 42, pp. 133–140, and in the literature cited there.

From PCT Applications WO A 86/06758 and WO A 86/06759, and corresponding U.S. Pat. No. 4,900,410, BENNETT, the use of expanded metals of titanium and other valve metals, or their alloys, as electrodes in cathodic protection against corrosion of concrete is known. The expanded metal, wound into rolls, can be applied to the surfaces to be protected by simply unrolling them; by means of a rhomboid mesh pattern, uniform current distribution with sufficient redundancy is attainable, and by electrocatalytic coating, a current density of 100 $mA/m^2$ for long-term operation is attainable.

It is difficult to protect a construction that is to be newly built with site-mixed concrete by means of framing by the above method; either the expanded metal acting as the anode must be affixed to the reinforcement by means of insulating spacers, or it must be attached to the finished poured concrete subsequently with dowels and then covered with sprayed concrete.

In the first case, short circuits can easily arise, if the concrete is compacted with vibrating machines; moreover, laying of the sheets of expanded metal can be done only by hand, which is highly time consuming; in the second case, relatively high costs must be expected.

It is also known from European Published Application A 0 147 977 to build up a cathodic protection against corrosion by means of a flexible mesh, acting as an anode, of electrical leads with graphited plastic sheathing; the mesh is secured to the surface of the concrete by coating with ion-conductive material; the ion-conductive material has at least the same ion conductivity as the concrete. It is also possible to use prefabricated slabs with embedded anode leads and connection leads extending out of them.

Vertical, pillarlike structures are protected by being wrapped with meshlike anode material.

Since the application to the surface of the concrete to be protected is done in several layers, this is a relatively expensive method; for vertical structures, the only feasible methods are wrapping them with anode material, or applying prefabricated slabs in which anode material is embedded to the surface of the concrete.

THE INVENTION

The object of the invention is to devise anodes that can be secured directly to the reinforcement or that can be placed in a reinforcing cage, without the possibility of short circuiting during the pouring and stirring of the site-mixed concrete into the frame; moreover, the anodes should be usable both in the production of finished concrete parts and in framing to produce concrete constructions.

In a preferred embodiment of the subject of the invention, the anode comprises a block of concrete within which is embedded a strip-like expended metal mesh of titanium or titanium alloy, provided with activation coating and poured into ion-conductive material, the anode having the shape of a bar with a round, oval or angular cross section; as the ion-conductive material, cement mortar or concrete are used, the mechanical properties of which are equivalent to that of the concrete to be protected; the cement mortar has at least the same ion conductivity as the concrete to be protected; hereinafter, the cement mortar will also be referred to as concrete. Titanium or titanium alloy leads are extended to the outside at one or both ends of the bar and are electrically connected to the expanded metal mesh, for example by welding. The expanded metal mesh is surrounded by an activation layer, which enables carrying current to the ion-conductive part of the anode by electrocatalytic means. For coating the mesh, metals or oxides of the platinum metal group typically used in the industry are preferably used.

The anode according to the invention can further more be used as a framing element for a concrete frame, instead of the framing boards typically used; it is moreover possible to use the anode according to the invention as a foundation element for producing a finished concrete part.

According to the invention, the economic use of activated titanium expanded metal proves to be particularly advantageous; because of the narrow, elongated form of the anode, not only columns, cross beams, and stairs but also walls or horizontal concrete surfaces can be protected in a simple manner; because of the composite structure of the anode, destruction of the anode when it is installed or when the concrete is compacted does not ensue.

BRIEF DESCRIPTION OF THE DRAWINGS

The subject of the invention is described in further detail below in conjunction with FIGS. 1 and 2. FIG. 1 shows an exemplary embodiment of the anode according to the invention, while

DETAILED DESCRIPTION

Figure 1:
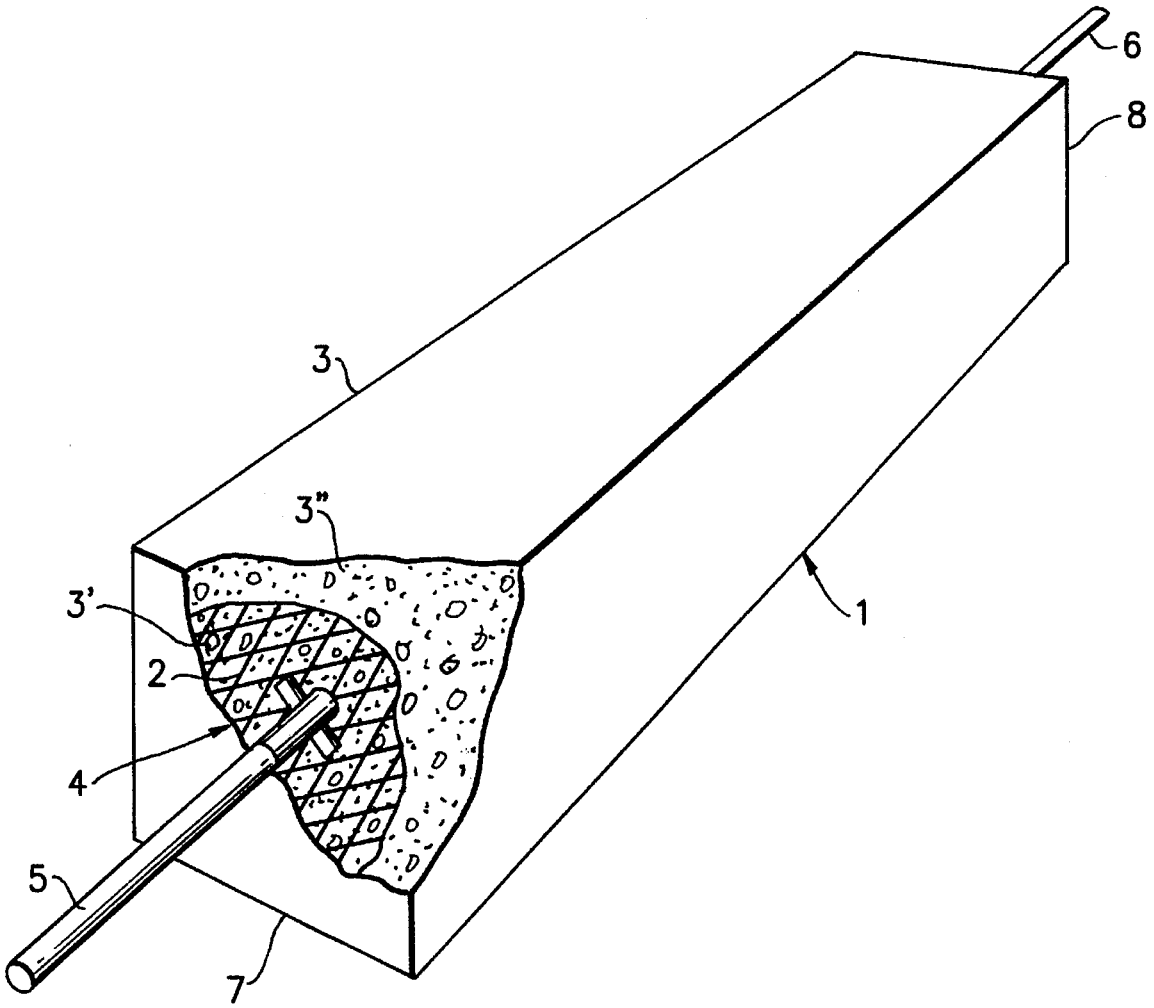

According to FIG. 1, the anode 1 is a block which comprises an electronconductive core 2 of rectangular shape and made of expanded metal mesh, and an ion-conductive jacket 3 made of cement-rich mortar; the expanded metal mesh is completely surrounded by the block-shaped ion-conductive jacket 3. In the region of the two short sides 4 of the expanded metal mesh that has titanium or titanium alloy as its core 2, there is a respective bolt 5, 6, serving as an electrical connection, of titanium or titanium alloy, connected to the expanded metal mesh by spot welding. The expanded metal mesh has a planar surface and is disposed with its short sides 4 parallel to the surface diagonals of the short sides 7, 8 of the block 1 and the ion-conductive jacket 3. The bolts 5, 6 extended to the outside in the center of the short sides 7, 8 and are provided with an insulating sheathing. In FIG. 1, for the sake of a better overview, the concrete located beneath the expanded metal mesh in the cutaway portion of the block 1 is identified by reference numeral 3', while the concrete located above the expanded metal mesh is identified by reference numeral 3".

However, it is also possible to use composite bodies having a round or oval cross section, instead of the rectangular profile of the anode.

The production of the anode according to the invention is done in a block-shaped frame; the expanded metal mesh serving as the core 2 is suspended by its two bolts 5, 6 in the frame in such a way that the short sides 4 of the mesh extend diagonally to the rectangular head ends of the frame. After the addition of cement-rich mortar and curing of the mortar, the frame can be removed.

Figure 2:
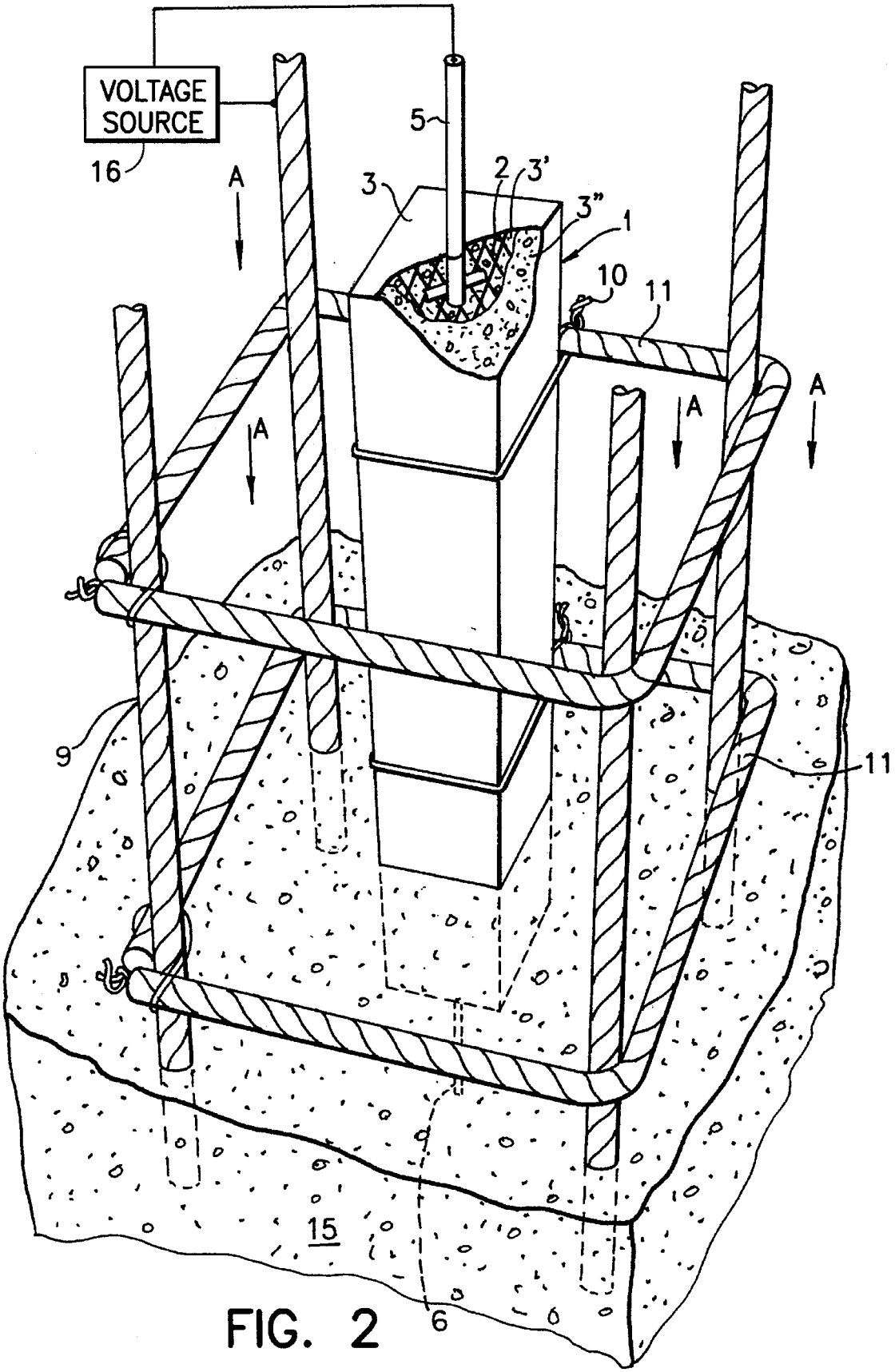
FIG. 2 shows the use of the anode in the reinforcement cage of a concrete pillar.

FIG. 2 shows the use of the anode according to the invention in the reinforcement cage of a concrete pillar, in which for the sake of a better overview only a detail of the iron reinforcement 9 is shown. The anode block 1 is firmly attached, simply with band material 10, to two parallel iron reinforcing bars 11 located one above the other; the now-rigid ion-conductive jacket 3 that touches the reinforcing bar prevents any danger of short circuiting between the reinforcing bar 11 and the expanded metal mesh 2. A plurality of such anodes can also be inserted into one reinforcement cage as needed. Next, the filling with site-mixed concrete takes place,see arrows A, FIG. 2; the site-mixed concrete enters into a positive, ion-conductive bond with the ion-conductive jacket 3 of the anode 1. After curing of the concrete to form structure is, the anode via bolt conductors 5,6 and the reinforcement bars 11 are connected to a direct voltage source 16, shown only schematically.

From the exemplary embodiment shown in FIG. 2, it is apparent that applying an external anode protection mesh is extremely difficult; with a narrow pillar, installing anode wires or flexible cables is equally possible only with great difficulty.

A further use of the anode according to the invention is in the production of finished concrete parts, where the anode is introduced into a mold for the finished concrete part and then surrounded by poured-in concrete.

The anode according to the invention can furthermore be used as a framing element for producing reinforced concrete constructions; it proves to be particularly practical that it is possible to provide two slack reinforcements with a corrosion protection system in a single operation, by replacing both the front wall and rear wall of the previously typical frame with board-like anodes or finished concrete parts with anodes cast in according to the invention.

We claim:

1. A method for protecting steel reinforcement bars (11) in a reinforced concrete construction (15), comprising providing a sub-assembly anode structure having a rigid block (1) of concrete containing ion-conductive cement, and a core (2) of a valve metal provided with an activation layer included and embedded within said block (1) of concrete, said block (1) extending spatially beyond said valve metal;

immovably securing the block (1) with the core (2) therein to at least one of said steel reinforcement bars (11) in the reinforced concrete construction;

pouring mixed concrete around the steel reinforcement bars (11) and said block (1) to embed said block secured to said at least one reinforcement bar and others of said bars (11) within the poured concrete;

permitting the poured concrete to cure; and connecting said core (2) and at least one of said steel reinforcement bars (11) to the terminals of a direct current electrical energy source (16).

2. The method of claim 1, wherein said core (2) of valve metal comprises a mesh structure; and at least one electrical terminal (5) is provided, extending externally of said jacket, for connection to said voltage source (16).

3. The method of claim 1, wherein said step of immovably securing the block to at least one of the steel reinforcement bars (11) comprises strapping said block (1) to said at least one of said reinforcement bars (11).

4. A method of constructing a pillar of reinforced concrete, in accordance with the method as claimed in claim 1, wherein said reinforcement bars comprises a first plurality of spaced upright reinforcement bars, and a second plurality of reinforcement rings surrounding said spaced upright reinforcement bars, to form a cage therebetween;

including the step of first inserting said sub-assembly comprising the block (1) with the core (2) therein within said cage; and wherein, the immovable securing step comprises firmly strapping said sub-assembly to at least one of said reinforcement bars (11) prior to the step of pouring the concrete around the reinforcement bars (11) and said sub-assembly.

5. The method of claim 4, further including the step of stirring and compacting the poured concrete around and within said cage and about said sub-assembly before permitting said concrete to cure.

6. The method of claim 1, further including the step of stirring and compacting the poured concrete around said reinforcement bars and about said sub-assembly before permitting said concrete to cure.

* * * * *